US005658170A

United States Patent [19]

Tan et al.

[11] Patent Number: 5,658,170

[45] Date of Patent: Aug. 19, 1997

[54] CABLE CONNECTOR ASSEMBLY

[75] Inventors: Haw-Chan Tan, Diamond Bar; Tim S. L. Chang, Chino Hills, both of Calif.

[73] Assignee: Hon Hai Precision Ind. Co., Ltd., Taipei Hsien, Taiwan

[21] Appl. No.: 533,794

[22] Filed: Sep. 26, 1995

[51] Int. Cl.[6] ..... H01R 9/03

[52] U.S. Cl. ..... 439/610; 439/936

[58] Field of Search ..... 439/607–610, 439/936

[56] References Cited

U.S. PATENT DOCUMENTS 5,267,882 12/1993 Davis ..... 439/610 X 5,456,618 10/1995 Nakamura ..... 439/610

*Primary Examiner*—Khiem Nguyen

[57] ABSTRACT

A cable connector assembly (20) for use with USB receptacle connector (1), includes an insulative housing (26) having a main body (28) from which a plug section (30) extends forward and a platform section (32) extends rearward. A plurality of passageways (34) extend through the housing in a front-to-end direction for receiving a corresponding number of contacts (40) therein. A pair of protrusions (29) and a recess (25) are formed on the surface of the main body of the housing. A shell (60) generally surrounds the main body (28) the plug section (30) of the housing (26) with the apertures (66) for engagement with the housing (26) and for securement of the whole cable connector assembly (20). A round cable includes a plurality of internal wires (70) respectively soldered to the rear end of the corresponding contacts (40). An epoxy layer (88) covers the solder joints of the cable wires (70) and the contacts (40), and also fastens the wires (70) of the cable in position with regard to the whole cable connector assembly (20). An over-molded jacket (80) encompasses the pre-assembled and premolded housing (26) with the shell (60) and the epoxy layer (88) thereon wherein a copper foil (76) is used for grounding with the shell (60) on the housing (26) and the drain wire shield (78) in the cable cover (72).

19 Claims, 7 Drawing Sheets

CABLE CONNECTOR ASSEMBLY

BACKGROUND OF THE INVENTION

1. Field of the Invention

The invention relates to cable connector assemblies, particularly to the plug-like cable connector assembly for use with the USB (Universal Serial Bus) receptacle connector.

2. The Prior Art

The USB connector is generally a new type connector in the computer field, which is intended to replace and integrate most existing different I/O connectors, such as D-Sub connector and Mini-Dins which are positioned on the backpanel of the computer, to be in a standard unique form. FIG. 1 shows one type proposed USB receptacle connector and its mating corresponding plug-like cable connector assembly disclosed in Universal Serial Bus Specification Revision 0.9 wherein the receptacle connector 1 includes a housing 2 with a shell 3 surrounding the housing 2 and a space between the housing 2 and the shell 3 for mating with the plug section 4 of the complementary cable connector assembly 5 therein for mechanical and electrical connection between the contacts 9 of the receptacle connector 1 and the contacts 10 of the cable connector assembly 5 whereby at least a pair of spring tangs 6 of the receptacle connector 1 can be engageably and latchably received within an opening 7 of the plug section 4 of the cable connector assembly 5.

The aforementioned defined specification only disclosed the dimension requirements between the receptacle and the complementary cable connector assembly. Therefore, an object of the invention is to provide a cable connector assembly for use with such USB receptacle connector to meet such requirements wherein the subject cable connector assembly is easily made with less components for reducing the manufacturing cost, and its structure is strong and reliable for assuring better mating with the corresponding receptacle connector.

SUMMARY OF THE INVENTION

According to an aspect of the invention, a cable connector assembly for use with USB receptacle connector, includes an insulative housing having a main body from which a plug section extends forward and a platform section extends rearward. A plurality of passageways extend through the housing in a front-to-end direction for receiving a corresponding number of contacts therein. A pair of protrusions and a recess are formed on the face of the main body of the housing. A shell generally surrounds the main body and the plug section of the housing with the apertures for engagement with the housing and for securement of the whole cable connector assembly. A round cable includes a plurality of internal wires respectively soldered to the rear ends of the corresponding contacts. An epoxy layer covers the solder joints of the cable wires and the contacts, and also fastens the wires of the cable in position. A over-molded jacket encompasses the preassembled and pre-molded housing with the shell and the epoxy layer wherein a copper foil is used for grounding with the shell on the housing and the drain wire shield in the cable.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
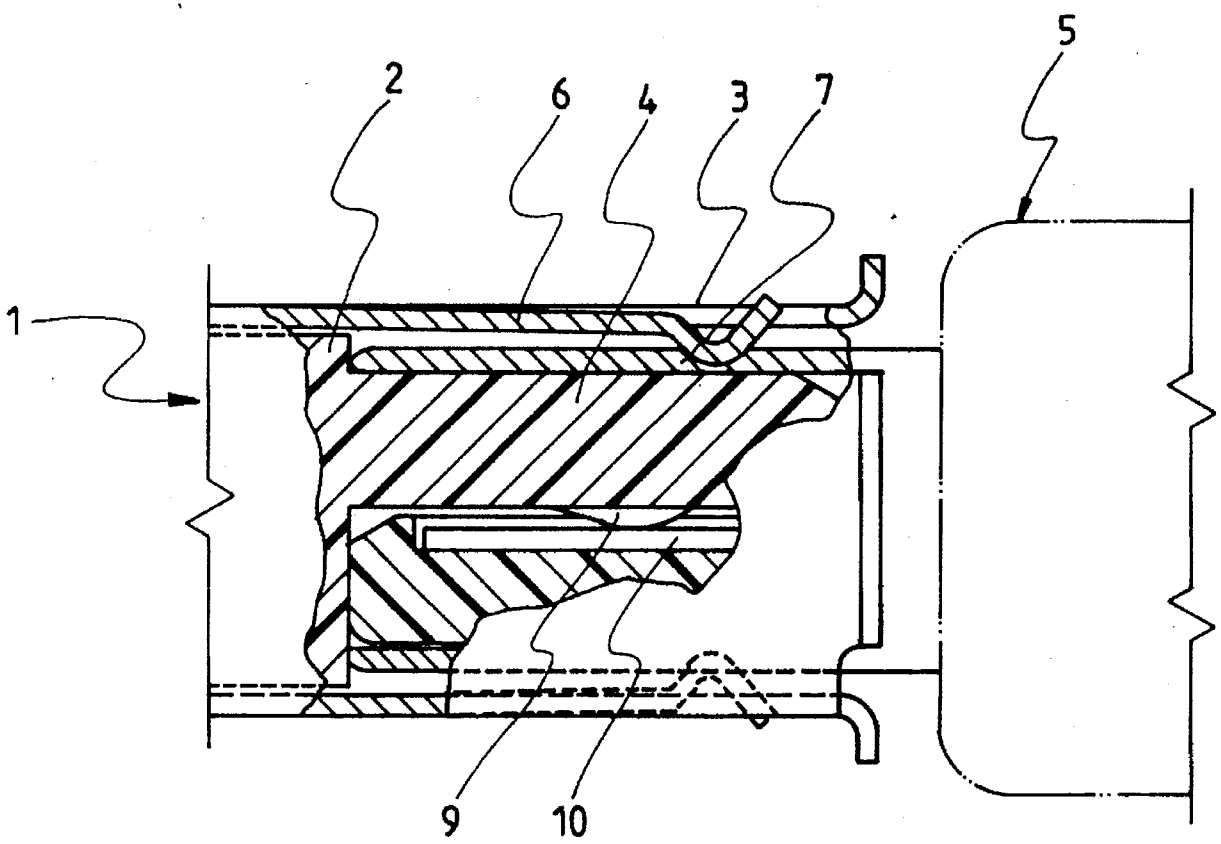
FIG. 1 is a fragmentary cross-sectional view of a USB receptacle connector and its mating cable connector assembly of the prior art.
Figure 2:
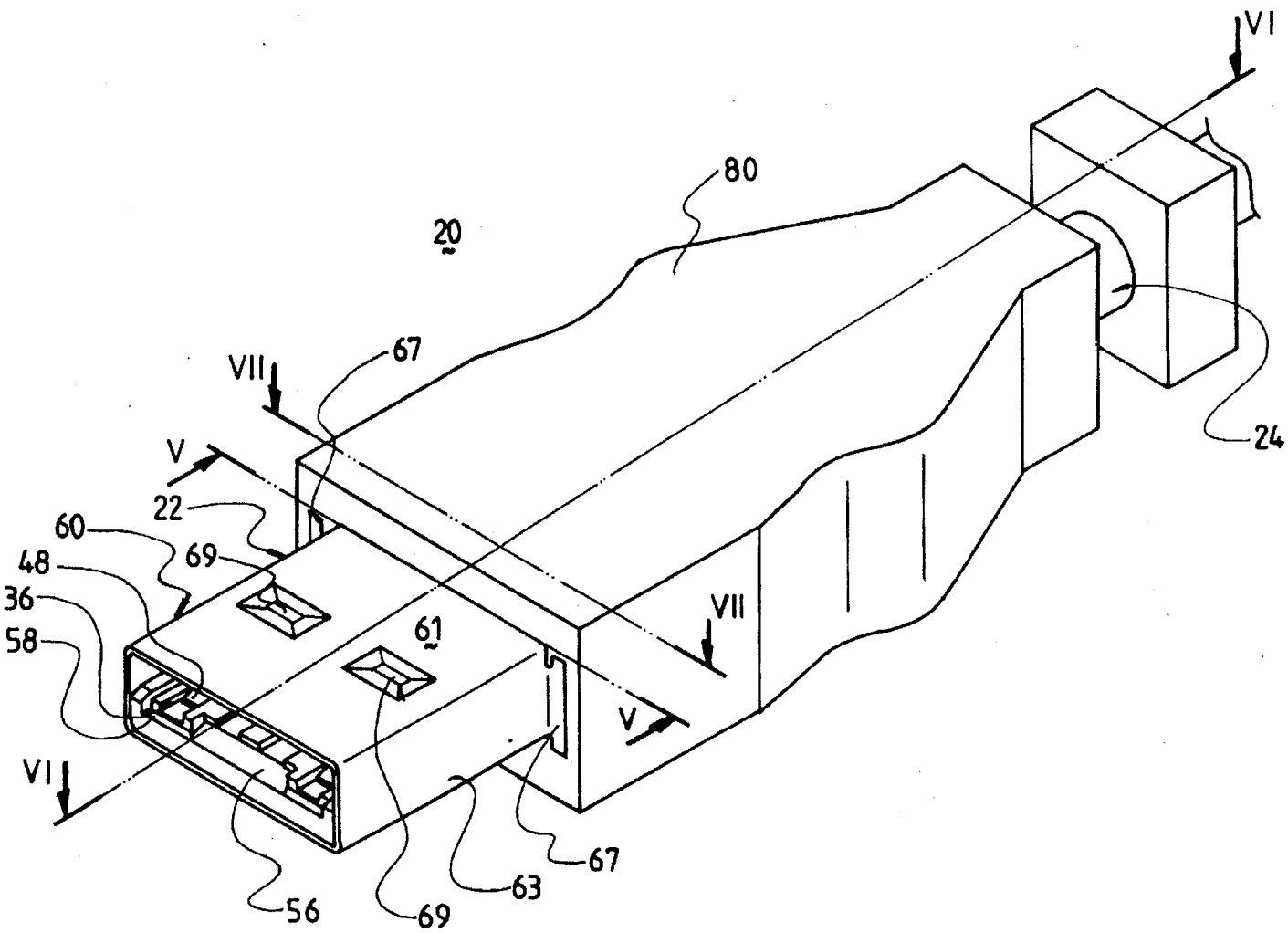
FIG. 2 is a perspective view of an assembled cable connector assembly according to the invention.
Figure 3:
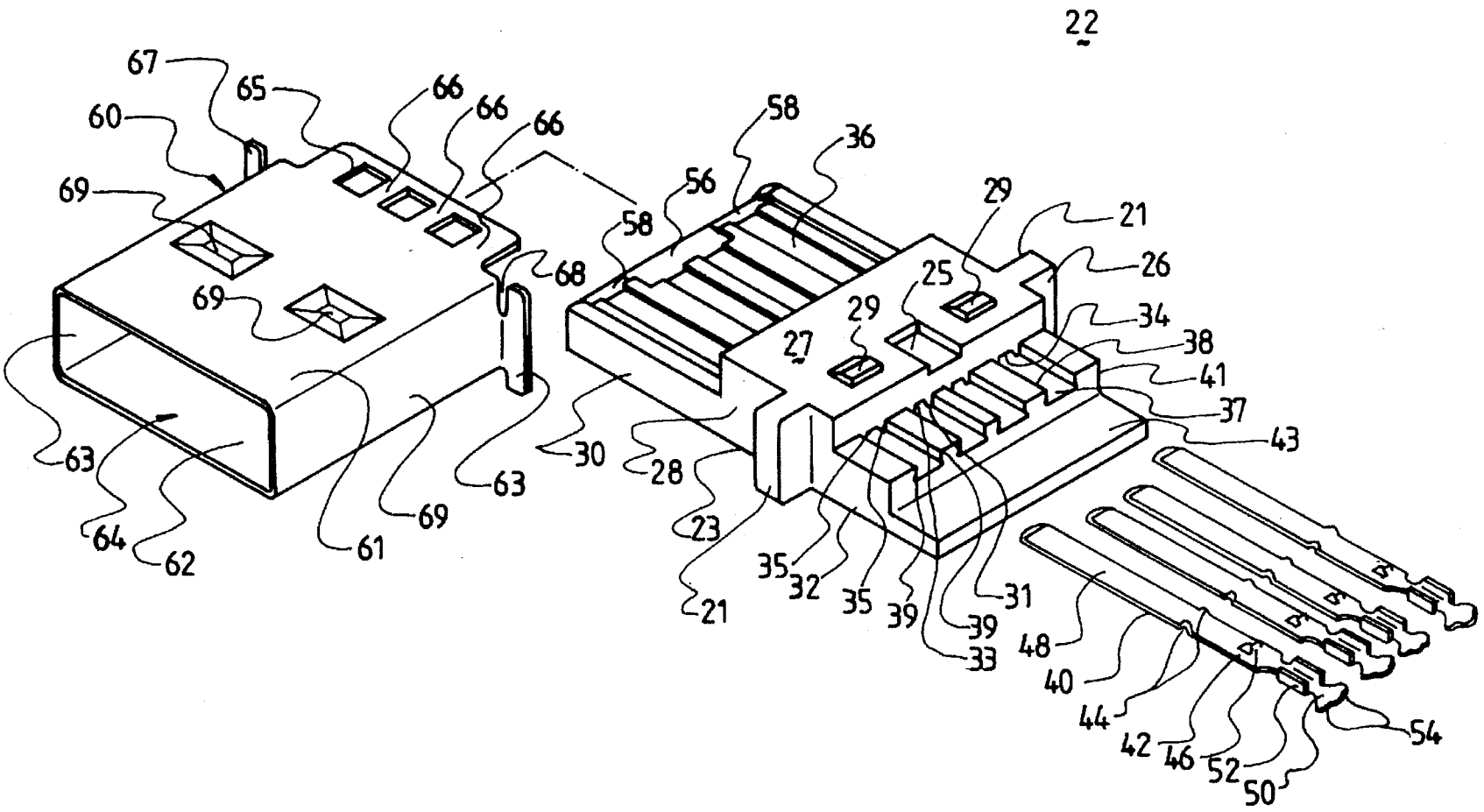
FIG. 3 is an exploded perspective view of the housing, the shell and the contacts of the cable connector assembly of FIG. 2.
Figure 4:
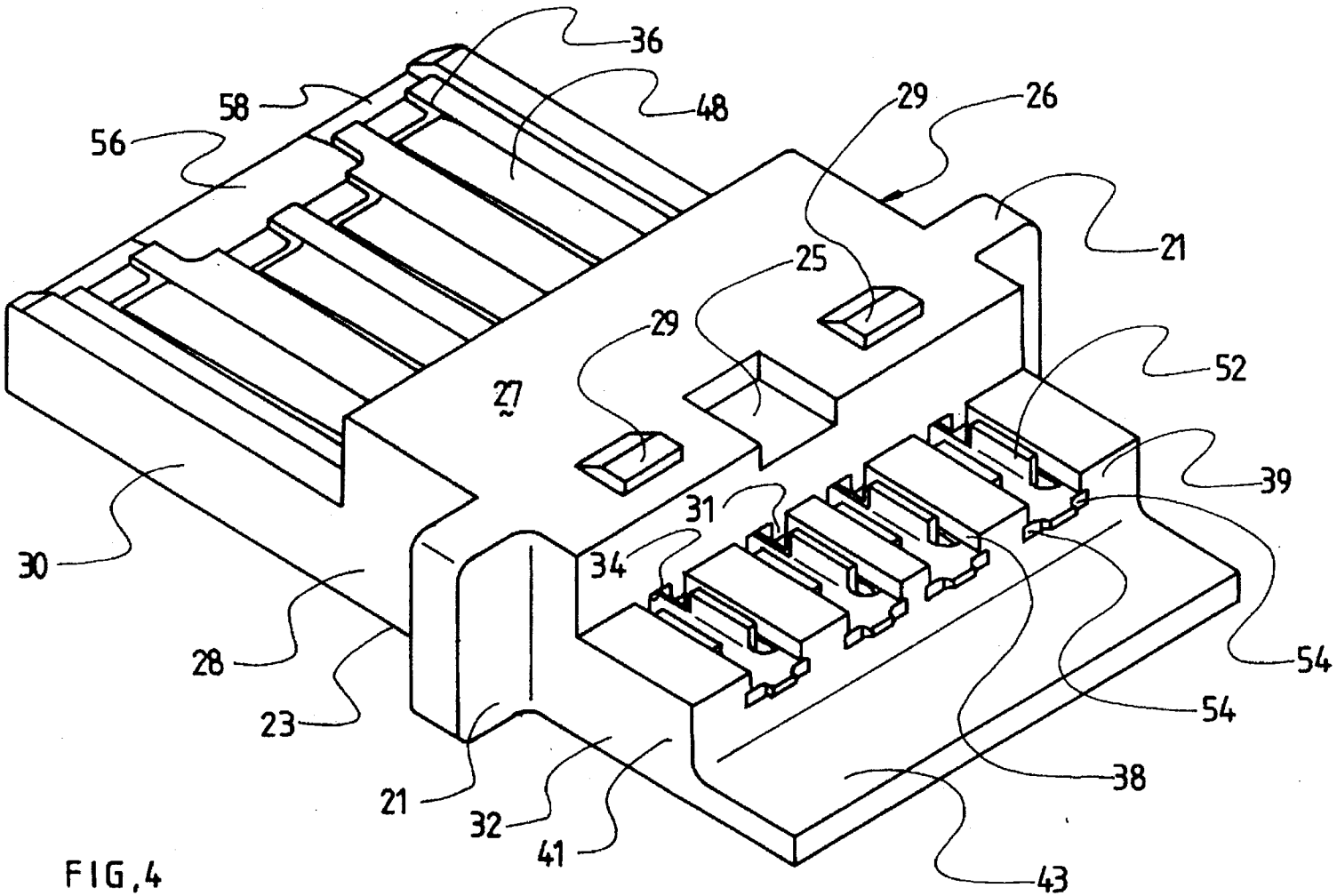
FIG. 4 is a perspective view of the assembled housing and contacts of FIG. 2.

It will be noted here that for a better understanding, most of like components are designated by like reference numerals throughout the various figures in the embodiments. Attention is now directed to FIGS. 2–4, wherein a cable connector assembly 20 for use with a USB receptacle connector 1 as shown in FIG. 1, includes a connector end section 22 and a cable end section 24. Referring to FIG. 3, the connector end section 22 includes a insulative housing 26 comprising a main body 28, a plug section 30 on the front portion and a platform section 32 on the rear portion. A plurality of passageways 34 extend through the housing 26, thus forming the corresponding channels 36 in the plug section 30 and the corresponding shallows 38 in the platform section 32.

Each passageway 34 is adapted to receive a corresponding contact 40 therein. The contact 40 includes a main section 42 with two embossments 44 and an upward projecting tangs 46 thereon, a contact section 48 on the front portion and a soldering section 50 on the rear end wherein the soldering section 50 includes a cup-like segment 52 and a pair of side wings 54 at the outermost end. To receive the corresponding portions of the contact 40, the passageway 34 of the main body 28 has a pair of steps 35 on two sides, and the shallow 38 also has therein a pair of shoulders 39 on two sides. To reduce the insertion force during mating of the cable connector assembly 20 and the corresponding receptacle connector 1 as shown in FIG. 1, the middle two contacts 40 are little shorter than the other outer ones. Correspondingly, in the plug section 30 of the housing 26, a tapered surface 56 in front of the middle contacts 40 extend deeper than the beside other two tapered surfaces 58. Also referring to FIG. 6, to accommodate the dimension of the corresponding wires 70 (described later), the platform section 32 are formed of an upper portion 41 and a lower portion 43 wherein the upper portion 41 has the shallows 38 for holding the contact 40 therein, and the lower portion 43 is generally a flat surface for supporting the wires 70 thereon.

Figure 6:
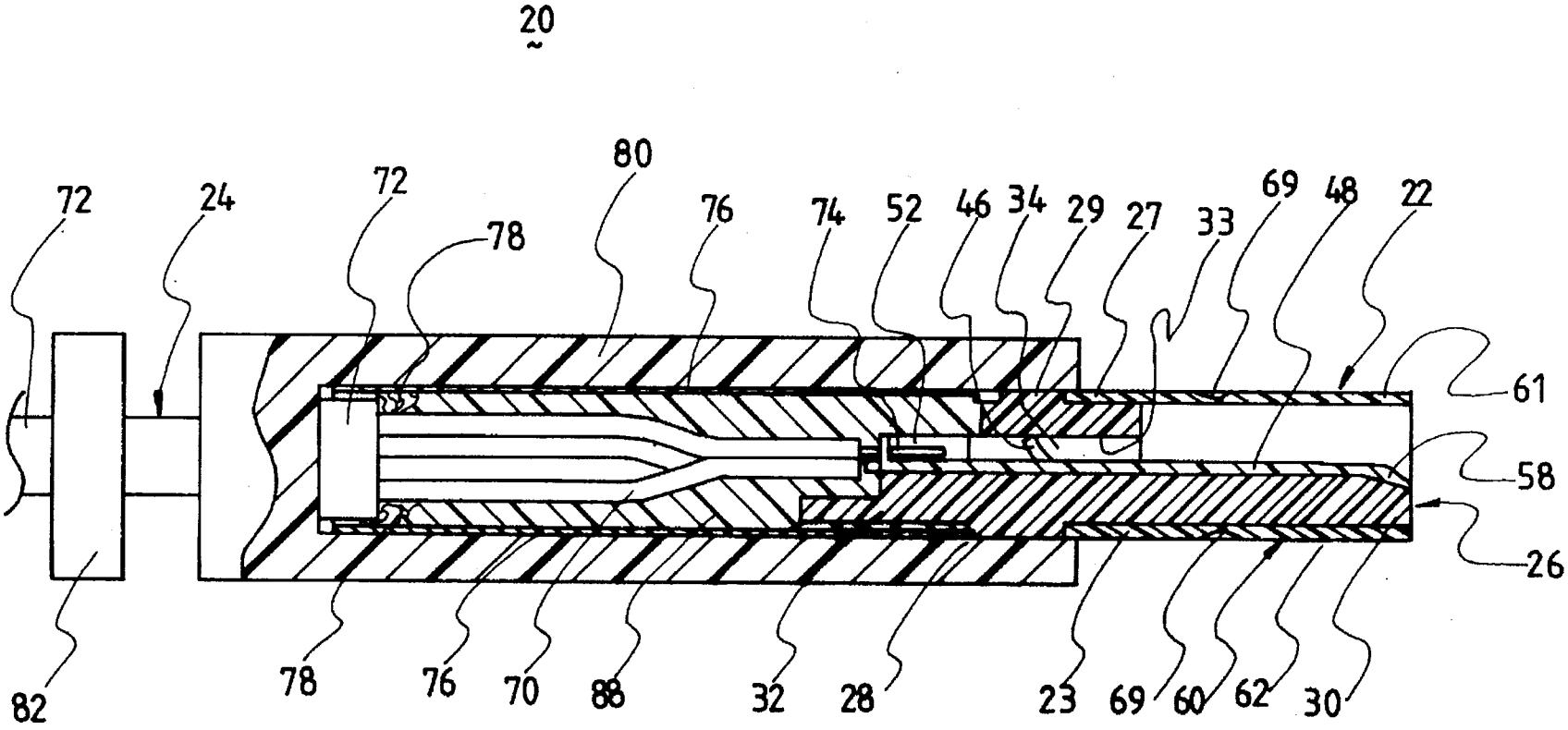
FIG. 6 is a cross-sectional view of the assembled cable connector assembly of FIG. 2 to show the internal structure relationship among the jacket, the housing, the contacts, the shell, the wires, the drain wire shield and the copper foil.

As aforementioned, the passageway 34 in the main body 28 has a pair of steps 35 on two sides in compliance with the corresponding inserted contact 40 so that when the contact 40 is received within the passageway 34, the two embossments 44 are generally engaged with the lower top surface 31 in the passageway 34, and the tang 46 is engaged with the upper top surface 33 in the passageway 34 (also see FIG. 6). Thus, the contact 40 can be retained within the corresponding passageway 34. Understandably, the contact sections 48 of the contacts 40 are respectively received within the corresponding channels 36 in the plug section 30, and the soldering sections 50 of the contacts 40 are respectively received within the corresponding shallows 38 in the platform section 32 wherein the cup-like segment 52 of the soldering section 50 of each contact 40 is sandwiched between two shoulders 39 of the corresponding shallow 38 of the platform section 32 and two wings 54 of the soldering section 50 of each contact 40 are sandwiched between two shoulders 39 and the bottom surface 37 in the corresponding shallow 38 (FIG. 4).

The pre-assembled housing 26 and contacts 40 as shown in FIG. 4 then is ready to be assembled to the conductive shell 60 as shown in FIGS. 2 and 3. The shell 60 generally formed by metal, includes a top wall 61 and its opposite bottom wall 62 and two side walls 63 opposite to each other to commonly form an internal cavity 64 for mainly receiving therein the plug section 30 of the housing 26 and the front portion of the main body 28 of the housing 26 wherein the corresponding receptacle connector 1 as shown in FIG. 1 is designedly received also in such cavity 64 to engage the corresponding plug section 30 of the subject cable connector assembly 20.

The top wall 61 further includes a rearward extending projecting plate 65 having a middle and two side apertures 66 therein for engagement with the main body 28 of the housing 26. Correspondingly, the main body 28 of the housing 26 on its top surface 27 includes a pair of protrusions 29 and a recess 25 intermediating therebetween. Therefore, when the shell 60 is attached to the housing 26, the two protrusions 29 on the main body 28 of the housing 26 are designedly adapted to be received within the corresponding two side apertures 66 in the shell 60, and the middle aperture 66 is aligned with the corresponding recess 25 in the main body 28 of the housing 26. Similarly, the bottom wall 62 of the shell 60 and bottom surface 23 of the main body 26 also have the same means for the same purpose as partially shown in FIG. 6. Indents 69 are formed in the top wall 61 and the bottom wall 62 for latchable engagement with the tangs or the embossments on the corresponding receptacle connector 1 as shown in FIG. 1.

The two side walls 63 of the shell 60 further include engagement plates 67 respectively extending outwardly and laterally from their rear edges 68 for abutment with corresponding supporting walls 21 extending laterally on two sides of the main body 28 of the housing 26.

Figure 5:
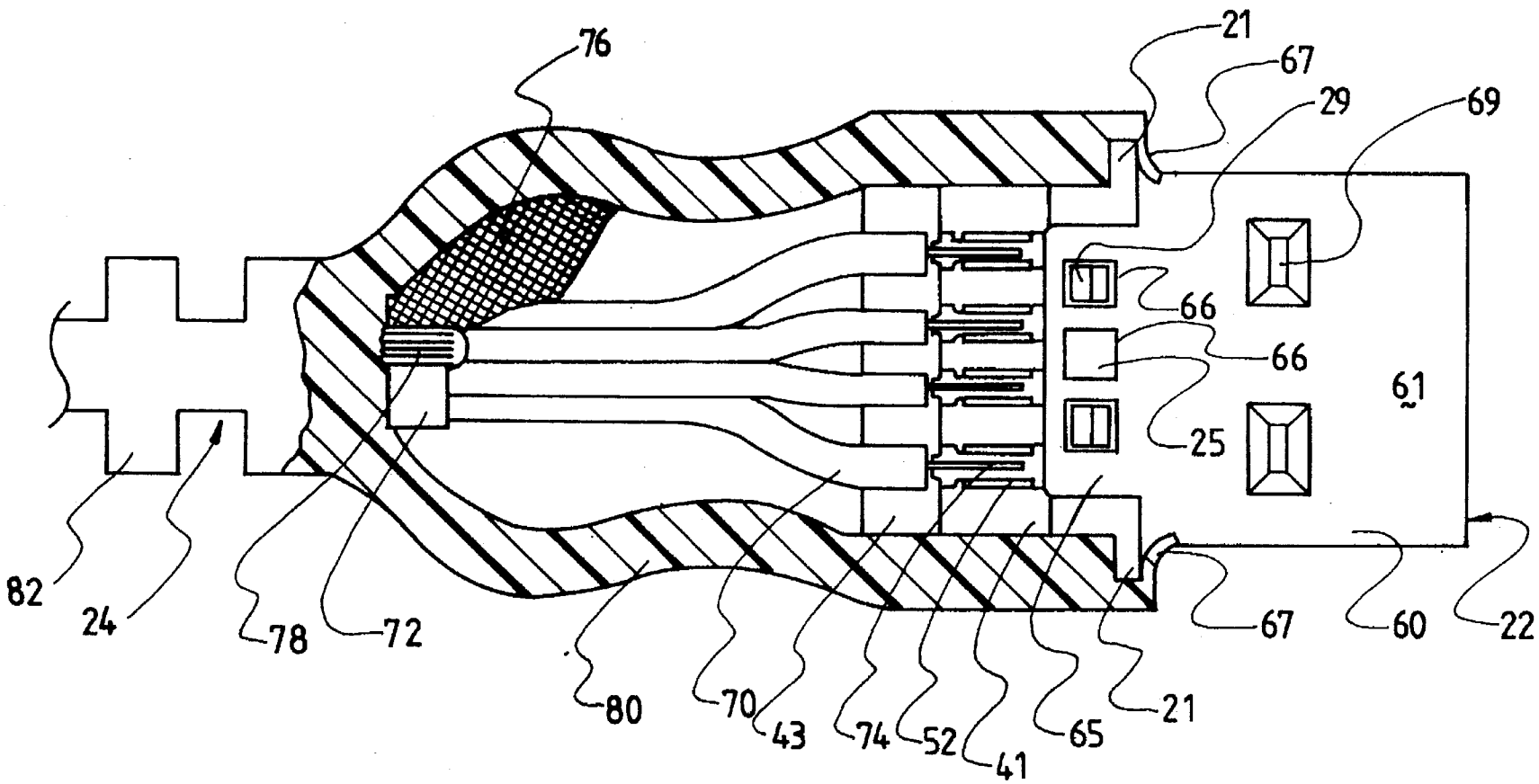
FIG. 5 is a top view of the assembled cable connector assembly of FIG. 2 wherein the jacket is partially cut out to show the positions of the wires of the cable in the jacket and the relationship thereof with regard to the corresponding contacts.
Figure 7:
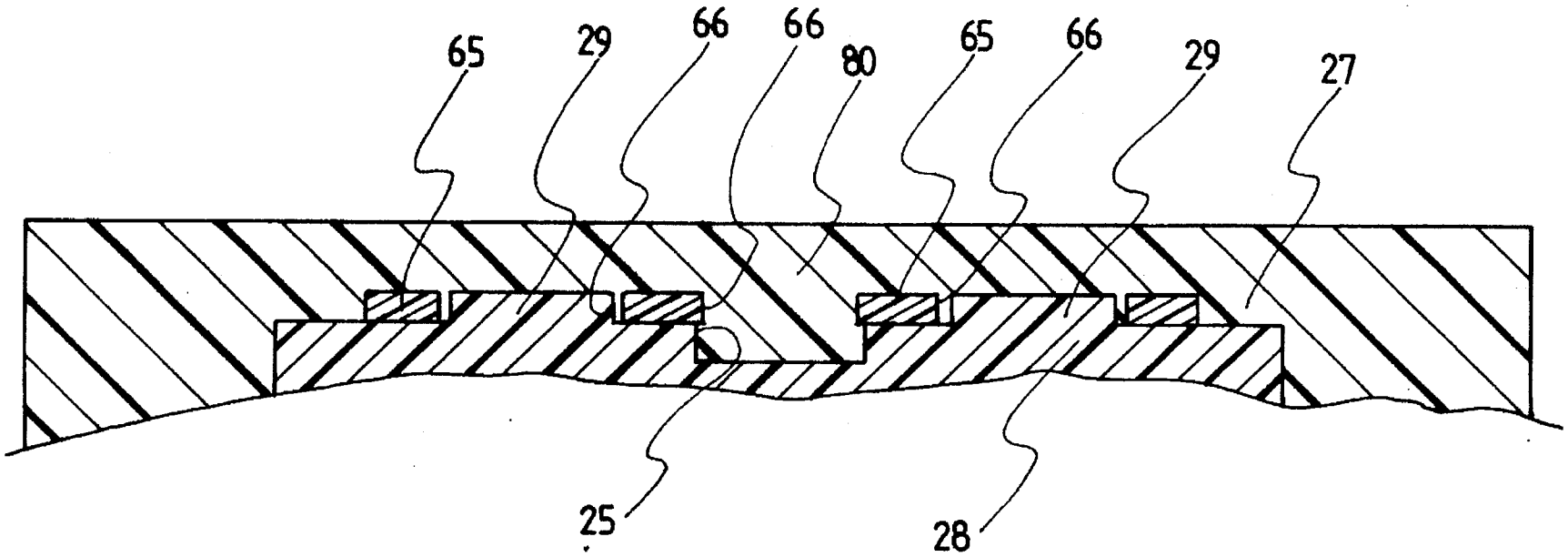
FIG. 7 is a partially vertical cross-sectional view of the assembled cable connector assembly of FIG. 2 to show the engagements among the jacket, the shell and the housing.

After the shell 60 is fastened to the housing 26 having the contacts 40 therein, such pre-assembly is ready to be molded for forming its final manner. Referring to FIGS. 5–7, the cable end section 24 including four tiny wires 70 surrounding by an insulative tubular outermost cover 72 are designedly attached to the rear portion of the connector end section 22. As well known, each wire 70 is composed of the insulative external covering and the conductive internal conductor 74. Thus, the conductors 74 can be soldered to the corresponding cup-like segments 52 of the contacts 40, respectively. Successively, a generally transparent epoxy layer 88 is applied onto the front portion of the cable end section 24 and the rear portion of the connector end section 22 as shown in FIG. 6 to protectively fasten these two portions with each other preliminarily. Such epoxy layer 88 may be deemed as a premolded material for the whole final assembly.

Consecutively, referring to FIGS. 5 and 6, a copper foil 76 surrounds the pre-molded epoxy layer 88 with the corresponding connector end section 22 and cable end section 24 therein wherein the front end of such copper foil 76 contacts the shell 60 of the connector end section 22, and the rear end of such copper foil 76 contacts a conductive drain wire shield 78 which is generally sandwiched between the internal wires 70 and the external tubular cover 72. FIGS. 5 and 6 show such drain wire shield 78 is backward folded over the external cover 72 for electrically engaging the copper foil 76. The whole pre-assembly including the connector end section 22 and the cable end section 24, is ready for the final molding process.

Lastly, a jacket 80 is over-molded on such pre-assembly through an insert molding process whereby the liquid type jacket 80 is shot into the mold which surrounds such pre-assembly and also into the recess 25 in the main body 28 of the housing 26 as shown in FIG. 7. It can be noted that the shell 60 is securely fastened to the housing 26 by means that the two protrusions 29 of the main body 28 of the housing 26 are snugly received with the corresponding two side apertures 66 in the shell 60, and the molded jacket 80 extends through the middle aperture 66 of the shell 60 and even invade the recess 25 in the main body 26, so that the molded jacket 80 can be firmly and circumferentially fastened to such pre-assembly, i.e., the connector end section 22 and the cable end section 24, without any axial and/or radial relative movements. It is also appreciated that the final subject cable connector assembly 20 includes some rings 82 formed integrally with the jacket 80 for reinforcement consideration.

The invention generally provides a cable connector assembly 20 with easy assembling and reliable structure. The wings 54 of the contacts 40 are substantially engaged with the shoulders 39, the cup-like segments 52 are substantially supportably received within the shallows 38, and the lower portion 43 of the platform section 32 supports the wires 70. Furthermore, the copper foil 76 cooperates with the shell 60 and the drain wire shield 78 to form a shielding/grounding means for substantially preventing any external electron-magnetic interference from improperly invading the interior of the whole assembly and efficiently protecting the signals transmitted by the contacts 40 or wires 70 therein.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A cable connector assembly comprising:

a connector end section and a cable end section;

said connector end section including:

an insulative housing comprising a main body, a plug section on a front portion and platform section on a rear portion;

a plurality of passageways extending through the housing;

a plurality of contacts received in the corresponding passageways wherein each of said contacts includes a main section having retention means thereon for retaining the contact within the corresponding passageway, a contact section on a front portion for being positioned on the plug section of the housing, and a soldering section on a rear portion for being positioned on the platform section of the housing;

a conductive shell having fastening means for attachment with the housing;

a jacket molded over a rear portion of the connector end section and a front portion of the cable end section; wherein said cable end section includes an external tubular cover surrounding a plurality of wires each having a conductor therein whereby the conductor of each wire can be electrically and mechanically connected to the soldering section of the corresponding contact, and wherein an epoxy layer is applied onto the platform of the housing and the wires of the cable end section for protectively fastening the soldering sections of the contacts and the wires of the cable end section together.

2. The cable connector assembly as defined in claim 1, wherein a copper foil is positioned within the jacket, and is respectively connected to the shell of the connector end section and a conductive drain wire shield sandwiched between the external tubular cover and the internal wires of the cable end section for preventing electron-magnetic interference in-and-out.

3. The cable connector assembly as defined in claim 1, wherein each of the passageways in the main body of the housing includes a pair of steps on two sides for engagement with a pair of embossments formed on two sides of the main section of each of the contacts, and each of the contacts further includes an upward projecting tang for engagement with an upper surface in the corresponding passageway in the main body of the housing.

4. The cable connector assembly as defined in claim 1, wherein each of the passageways in the platform section forms a corresponding shallow having a pair of shoulders on two sides whereby a pair of wings of each of the soldering section of the contact can be reliably engaged with said pair of shoulders for efficiently maintaining positioning of the solder section of the contact with regard to the platform of the housing, and a cup-like segment of the soldering section of each of the contacts can be sandwiched between said pair of shoulders of the corresponding shallow for easily soldering to the corresponding wire of the cable end section.

5. The cable connector assembly as defined in claim 1, wherein said platform includes an upper portion for receiving the soldering sections of contacts therein, and a lower portion for properly supporting wires of the cable end section.

6. The cable connector assembly as defined in claim 1, wherein said shell includes a top wall and an opposite bottom wall, and two opposite side walls to form a cavity therein for receiving the plug section of the housing, and wherein the top wall and the bottom wall have rearward projecting plates having plural apertures therein for fastening to the main body of the housing, and two side walls have laterally extending engagement plates for engagement with two corresponding supporting walls laterally extending from the main body of the housing.

7. The cable connector assembly as defined in claim 6, wherein the main body of the housing includes plural protrusions on at least one surface for engagement with the corresponding apertures in the shell for fastening the housing and the shell together, and includes at least one recess in alignment with at least one aperture in the shell to cooperate with the molded jacket for integrating the jacket, the housing and the shell as one piece.

8. The cable connector assembly as defined in claim 1, wherein the contact sections of the contact have two different lengths and the plug section of the housing has different tapered surfaces, correspondingly, for reducing an insertion force with regard to a complementary receptacle connector.

9. A semi-finished cable connector assembly comprising:

an insulative housing including a main body, a plug section on a front portion and a platform section on a rear portion;

a plurality of passageways extending through the housing for receiving a corresponding number of contacts therein;

each of the contacts including a main section, a contact section on a front portion and a soldering section on a rear portion;

a conductive shell including a top wall, an opposite bottom wall, and two opposite side walls commonly defining a cavity therein for receiving the plug section of the housing therein;

first fastening means positioned on the shell and the housing for securing the shell to the housing; and second fastening means positioned on the shell and the housing for securing said shell and said housing integrally to an insulative jacket over-molded thereon.

10. The semi-finished cable connector assembly as defined in claim 9, wherein said first fastening means includes at least a protrusion on the main body of the housing and at least corresponding aperture in the shell.

11. The semi-finished cable connector assembly as defined in claim 9, wherein said second fastening means includes at least one recess in the main body of the housing and at least one corresponding aperture in the shell.

12. The semi-finished cable connector assembly as defined in claim 9, wherein said platform includes an upper portion for receiving the corresponding soldering sections of the contacts, and a lower portion for supporting a plurality of wires extending from a cable end section which is adapted to be attached to the platform to form a final whole cable connector assembly.

13. The semi-finished cable connector assembly as defined in claim 9, wherein said top wall and bottom wall of the shell have rearward projecting plates and said first and second fastening means are positioned therein, and said side walls have engagement plates laterally extending therefrom for engagement with corresponding supporting walls extending laterally on two side of the main body of the housing.

14. A method for assembling a cable connector assembly, the steps including:

a plurality of contacts being inserted into an insulative housing wherein said housing includes a main body, a plug section on a front portion and a platform section on a rear portion and each of said contacts includes a main section, a contact section on a front portion and a soldering section on a rear portion;

a conductive shell being attached to the housing by means of a first fastening means positioned on the shell and on the main body of the housing wherein said shell includes a top wall and an opposite bottom wall, and two opposite side walls;

a plurality of wires extending from an external insulative cover of a cable being soldered to the soldering sections of the corresponding contacts, respectively;

an epoxy layer being applied onto the platform of the housing and the wires for maintaining the wires and the soldering sections of the contacts in position and functioning as a pre-molding; and an insulative jacket being, via an insertion molding process, molded over the pre-assembled shell and housing with the integral epoxy thereon, and eventually being substantially integral with said pre-assembled shell and housing, by means of a second fastening means positioned in the shell and the housing.

15. The method as defined in claim 14, wherein before said jacket is molded thereon, a copper foil is applied thereto for conductive connection with the shell and a drain wire shield sandwiched between the wires and the external insulative cover, respectively, for preventing electron-magnetic interference.

16. The method as defined in claim 14, wherein said first fastening means includes at least one aperture in the shell and at least one corresponding protrusion on the main body of the housing.

17. The method as defined in claim 14, wherein said second fastening means includes at least one aperture in the shell and at least one corresponding recess in the main body of the housing whereby the jacket extends through said aperture and into said recess.

18. A cable connector assembly comprising:

a connector end section and a cable end section;

said connector end section including:

an insulative housing comprising a main body, a plug section on a front portion and platform section on a rear portion;

a plurality of passageways extending through the housing;

a plurality of contacts received in the corresponding passageways wherein each of said contacts includes a main section having retention means thereon for retaining the contact within the corresponding passageway, a contact section on a front portion for being positioned on the plug section of the housing, and a soldering section on a rear portion for being positioned on the platform section of the housing;

a conductive shell having fastening means for attachment with the housing;

a jacket molded over a rear portion of the connector end section and a front portion of the cable end section; wherein each of the passageways in the platform section forms a corresponding shallow having a pair of shoulders on two sides whereby a pair of wings of each of the soldering section of the contact can be reliably engaged with said pair of shoulders for efficiently maintaining positioning of the solder section of the contact with regard to the platform of the housing, and a cup-like segment of the soldering section of each of the contacts can be sandwiched between said pair of shoulders of the corresponding shallow for easily soldering to a corresponding wire of the cable end section.

19. A cable connector assembly comprising:

a connector end section and a cable end section;

said connector end section including:

an insulative housing comprising a main body, a plug section on a front portion and platform section on a rear portion;

a plurality of passageways extending through the housing;

a plurality of contacts received in the corresponding passageways wherein each of said contacts includes a main section having retention means thereon for retaining the contact within the corresponding passageway, a contact section on a front portion for being positioned on the plug section of the housing, and a soldering section on a rear portion for being positioned on the platform section of the housing;

a conductive shell having fastening means for attachment with the housing;

a jacket molded over a rear portion of the connector end section and a front portion of the cable end section; wherein said shell includes a top wall and an opposite bottom wall, and two opposite side walls to form a cavity therein for receiving the plug section of the housing, and wherein the top wall and the bottom wall have rearward projecting plates having plural apertures therein for fastening to the main body of the housing, and two side walls have laterally extending engagement plates for engagement with two corresponding supporting walls laterally extending from the main body of the housing; and wherein the main body of the housing includes plural protrusions on at least one surface for engagement with the corresponding apertures for fastening the housing and the shell together, and includes at least one recess in alignment with at least one aperture in the shell to cooperate with the molded jacket for integrating the jacket, the housing and the shell as one piece.

* * * * *